United States Patent [19]

Bland et al.

[11] Patent Number: 4,687,450

[45] Date of Patent: Aug. 18, 1987

[54] MARINE PROPULSION DEVICE EXHAUST SYSTEM

[76] Inventors: Gerald F. Bland, 2011 Fir St., Glenview, Ill. 60025; Stephen R. Johnson, 37116 N. Adelphi, Waukegan, Ill. 60085

[21] Appl. No.: 910,325

[22] Filed: Sep. 22, 1986

Related U.S. Application Data

[63] Continuation of Ser. No. 730,595, May 6, 1985, abandoned.

[51] Int. Cl.[4] ..... B63H 21/32

[52] U.S. Cl. ..... 440/89; 60/311

[58] Field of Search ..... 440/88, 89, 57; 60/309, 60/310, 311

[56] References Cited

U.S. PATENT DOCUMENTS

| | | | |
|---|---|---|---|
| 1,816,371 | 7/1931 | Hefti | 440/89 |
| 3,310,022 | 3/1967 | Kollman | 440/88 X |
| 3,750,614 | 8/1973 | Giacosa | 440/39 |
| 3,759,041 | 9/1973 | North et al. | 60/310 |
| 4,019,456 | 4/1977 | Harbert | 60/310 X |
| 4,354,849 | 10/1982 | Sanmi et al. | 440/88 |
| 4,504,238 | 3/1985 | Neisen | 440/89 |

FOREIGN PATENT DOCUMENTS

| | | |
|---|---|---|
| 710083 | 6/1954 | United Kingdom . |
| 1410489 | 10/1975 | United Kingdom . |

*Primary Examiner*—Joseph F. Peters, Jr.
*Assistant Examiner*—Paul E. Salmon

[57] ABSTRACT

A marine propulsion device comprising a water cooled internal combustion engine, a gimbal housing adapted to be mounted on a boat transom and including a front end, an exhaust opening in the front end, a first exhaust relief opening in the front end adjacent one side of the exhaust opening, a second relief opening in the front end adjacent the other side of the exhaust opening, an exhaust outlet, an exhaust conduit communicating between the exhaust opening and the exhaust outlet, a first exhaust relief passage communicating between the first exhaust relief opening and the atmosphere, and a second exhaust relief passage communicating between the second exhaust relief opening and the atmosphere, and an exhaust system communicating between the engine and the exhaust opening for conducting exhaust gases and coolant water away from the engine, and communicating between the engine and the first and second exhaust relief openings for conducting exhaust gases away from the engine.

12 Claims, 10 Drawing Figures

MARINE PROPULSION DEVICE EXHAUST SYSTEM

This application is a continuation of U.S. pat. application Ser. No. 730,595, filed May 6/85, now abandoned.

BACKGROUND OF THE INVENTION

The invention relates to exhaust systems for marine propulsion devices and, more particularly, to means in such exhaust systems for relieving exhaust gas backpressure.

In prior marine propulsion devices, it is common to discharge exhaust gases and coolant water underwater in order to reduce noise. This frequently results in undesirable backpressure on the engine, because the exhaust gases and coolant water must follow a relatively long path before being discharged.

Attention is directed to the following U.S. patents which disclose marine propulsion device exhaust systems:

North; U.S. Pat. No. 3,759,041, issued Sept. 18, 1973; and

Harbert; U.S. Pat. No. 4,019,456, issued Apr. 26, 1977.

SUMMARY OF THE INVENTION

The invention provides a marine propulsion device comprising a water cooled internal combustion engine, an exhaust outlet, an exhaust passageway communicating between the engine and the exhaust outlet and conducting exhaust gases and coolant water away from the engine, the exhaust passageway including a first portion in which the water flows due to centrifugal forces, and a second portion in laterally adjacent spaced relation from the first portion, and means for relieving back pressure in the exhaust passageway by conducting exhaust gases away from the second portion of the exhaust passageway.

In one embodiment, the relieving means includes an exhaust gas relief passage communicating between the second portion of the exhaust passageway and the atmosphere.

In one embodiment, the exhaust passageway also has an upper portion, and the exhaust gas relief passage communicates with the upper portion such that, due to the force of gravity and centrifugal forces, a substantial portion of the water does not enter the relief passage.

The invention also provides a marine propulsion device comprising a water cooled internal combustion engine, an exhaust outlet, an exhaust passageway communicating between the engine and the exhaust outlet and conducting exhaust gases and coolant water away from the engine, the exhaust passageway including an upper portion, and a downwardly extending exhaust gas relief passage communicating between the upper portion of the exhaust passageway and the atmosphere for conducting exhaust gases away from the exhaust passageway.

The invention also provides a marine propulsion device comprising a water cooled internal combustion engine, a gimbal housing adapted to be mounted on a boat transom and including a front end, an exhaust opening in the front end, a first exhaust relief opening in the front end adjacent one side of the exhaust opening, a second relief opening in the front end adjacent the other side of the exhaust opening, an exhaust outlet, an exhaust conduit communicating between the exhaust opening and the exhaust outlet, a first exhaust relief passage communicating between the first exhaust relief opening and the atmosphere, and a second exhaust relief passage communicating between the second exhaust relief opening and the atmosphere, and an exhaust system communicating between the engine and the exhaust opening for conducting exhaust gases and coolant water away from the engine, and communicating between said engine and the first and second exhaust relief openings for conducting exhaust gases away from the engine.

In one embodiment, the exhaust system includes a conduit section communicating with the exhaust opening and the first and second exhaust relief openings, the conduit section having opposite first and second sides, a bottom, a first dam extending upwardly from the bottom adjacent the first side and being positioned upstream of the first exhaust relief opening, and a second dam extending upwardly from the bottom adjacent the second side and being positioned upstream of the second exhaust relief opening, the bottom and the first and second dams defining a lower central portion of the conduit section, and the first and second dams substantially preventing water from entering the first and second exhaust relief openings, and a pair of exhaust pipes communicating between the engine and the conduit section, the exhaust pipes converging into the conduit section and having arcuate sections immediately upstream of the conduit section such that the water flows to the lower central portion of the conduit section due to centrifugal forces and the force of gravity.

In one embodiment, the exhaust conduit is generally horizontal and has an upstream end communicating with the exhaust opening, and a downstream end communicating with the exhaust outlet, the first exhaust relief passage has an upstream portion extending generally parallel to the exhaust conduit and communicating with the first exhaust relief opening, and a downstream portion extending generally downwardly and communicating with the atmosphere, and the second exhaust relief passage has an upstream portion extending generally parallel to the exhaust conduit and communicating with the second exhaust relief opening, and a downstream portion extending generally downwardly and communicating with the atmosphere.

In one embodiment, the exhaust system includes a conduit section including an end face abutting the front end of the gimbal housing, a bottom wall extending from the end face, a roof extending from the end face, a pair of sides extending upwardly from the bottom wall to define, in the end face, an exhaust discharge port communicating with the exhaust opening in the gimbal housing, the sides terminating in spaced relation to the roof to define ports, the roof including, adjacent the end face, projecting portions extending laterally outwardly beyond the sides, and the conduit section also including outer side walls extending downwardly from the roof in spaced outer relation to the sides and below the ports to define, in the end face, first and second exhaust relief ports respectively communicating with the first and second exhaust relief openings in the gimbal housing.

A principal feature of the invention is the provision of an exhaust passageway including a first portion in which water flows due to centrifugal forces, and a second portion spaced inwardly from the first portion, and means for relieving backpressure in the exhaust passageway by conducting exhaust gases away from the second portion of the exhaust passageway. Because exhaust gases are conducted away from the second portion of the exhaust passageway, removal of water from the exhaust passageway is substantially avoided, since the water flows to the first portion of the exhaust passageway.

Another principal feature of the invention is the provision of an exhaust passageway including an upper portion, and a downwardly extending exhaust gas relief passage communicating between the upper portion of the exhaust passageway and the atmosphere for conducting exhaust gases away from the exhaust passageway. Because the exhaust gas relief passage communicates with the upper portion of the exhaust passageway, removal of water from the exhaust passageway is substantially avoided, since the force of gravity keeps water in the lower portion of the exhaust passageway and out of the upper portion.

Another principal feature of the invention is the provision of a gimbal housing including a front end, an exhaust opening in the front end, a first exhaust relief opening in the front end adjacent one side of the exhaust opening, a second relief opening in the front end adjacent the other side of the exhaust opening, an exhaust outlet, an exhaust conduit communicating between the exhaust opening and the exhaust outlet, a first exhaust relief passage communicating between the first exhaust relief opening and the atmosphere, and a second exhaust relief passage communicating betwween the second exhaust relief opening and the atmosphere.

Other features and advantages of the invention will become apparent to those skilled in the art upon review of the following detailed description, claims and drawings.

Figure 1:
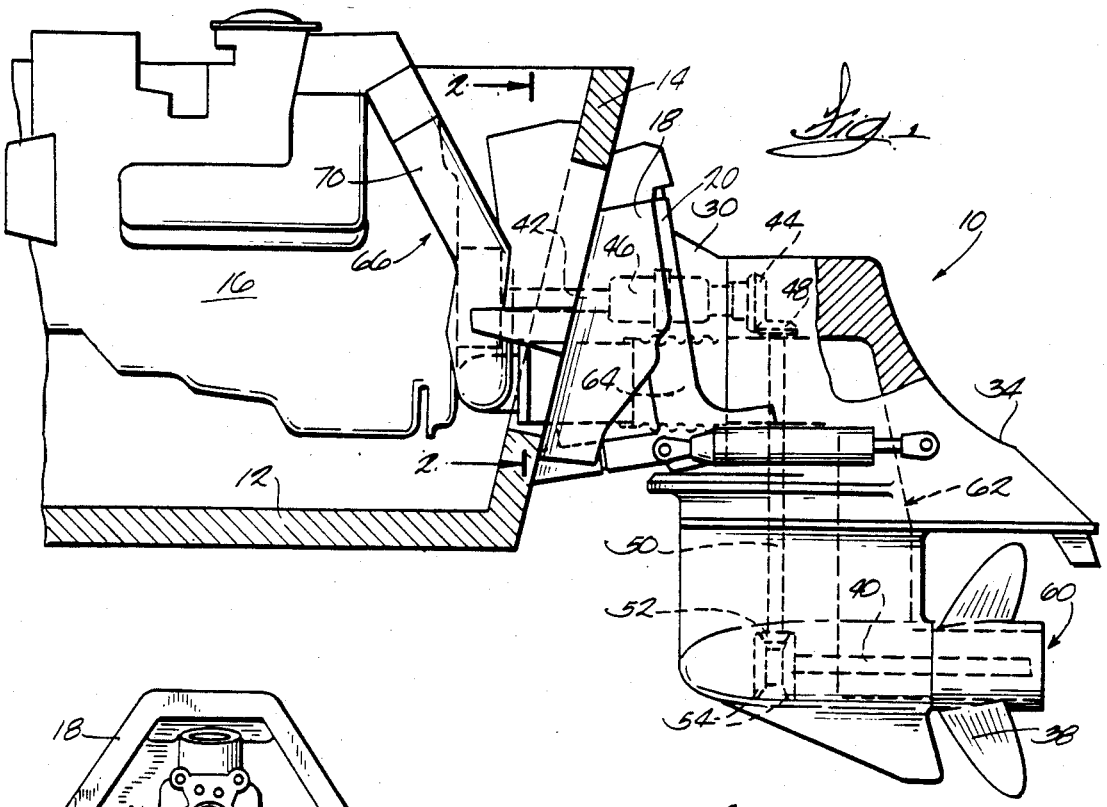
FIG. 1 is a side elevational view, partially cut away, of a marine propulsion device embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in the drawings is a marine propulsion device 10 mounted on a boat 12 having a transom 14. The marine propulsion device 10 is of the stern drive or inboard/outboard type.

As best shown in FIG. 1, the marine propulsion device 10 comprises an engine 16 securely mounted on the boat frame by suitable means such as rubber mounts (not shown). The marine propulsion device 10 also comprises a gimbal housing 18 mounted on the outer surface of the boat transom 14 and fixedly attached to the boat transom 14. The gimbal housing 18 can be attached to the boat transom 14 by any suitable means. such as bolts extending through the transom 14.

The marine propulsion device 10 also comprises a gimbal ring 20 connected to the gimbal housing 18 for pivotal movement relative to the gimbal housing 18 about a generally vertical steering axis (not shown), and a pivot housing 30 connected to the gimbal ring 20 for pivotal movement relative to the gimbal ring 20 about a generally horizontal tilt axis (not shown). Such a construction is well known in the art and need not be described in greater detail.

The marine propulsion device 10 also comprises a propulsion unit 34 removably connected to the pivot housing 30 for common pivotal movement of the propulsion unit 34 with the pivot housing 30. In the illustrated construction, the propulsion unit 34 is removably connected to the pivot housing 30 by a plurality of bolts (not shown). The propulsion unit 34 includes a propeller 38 mounted on a propeller shaft 40, and a generally horizontal drive shaft 42 having one end removably connected to the engine 16 and an opposite end having thereon a bevel gear 44. A universal joint 46 attached to the horizontal drive shaft 42 allows pivotal movement of the drive shaft 42 with the propulsion unit 34. The bevel gear 44 drives a bevel gear 48 on the upper end of a vertical drive shaft 50. The lower end of the vertical drive shaft 50 has thereon a driving gear 52. A reversible transmission selectively clutches a pair of driven gears 54 to the propeller shaft 40 to transmit forward or reverse motion to the propeller shaft 40 from the driving gear 52.

The marine propulsion device 10 also comprises means (not shown) for providing cooling water to the engine 16. Such means can include a pump for pumping water to the engine 16 as is well known in the art. The marine propulsion device 10 further comprises an exhaust outlet 60, and an exhaust passageway 62 communicating between the engine 16 and the exhaust outlet 60 and conducting exhaust gases and coolant water away from the engine 16. In the illustrated construction, the exhaust outlet 60 is located at the lower end of the propulsion unit 34 so that the exhaust gases are discharged underwater. It is well known in the art to discharge exhaust gases underwater in order to reduce noise.

In the preferred embodiment, the exhaust passageway 62 extends from the engine 16 to the gimbal housing 18, through the gimbal housing 18, from the gimbal housing 18 to the propulsion unit 34, and through the propulsion unit 34 to the exhaust outlet 60. The portion of the exhaust passageway 62 extending from the gimbal housing 18 to the propulsion unit 34 is a conventional exhaust bellows 64. The portion of the exhaust passageway 62 extending through the propulsion unit 34 is also conventional and need not be described in greater detail.

The portion of the exhaust passageway 62 extending between the engine 16 and the gimbal housing 18 is an exhaust system 66 including (see FIGS. 3 and 4) a conduit section 68 communicating with the gimbal housing 18 (see FIG. 8), and a pair of exhaust pipes 70 communicating with the engine 16 and converging into the conduit section 68.

Figure 3:
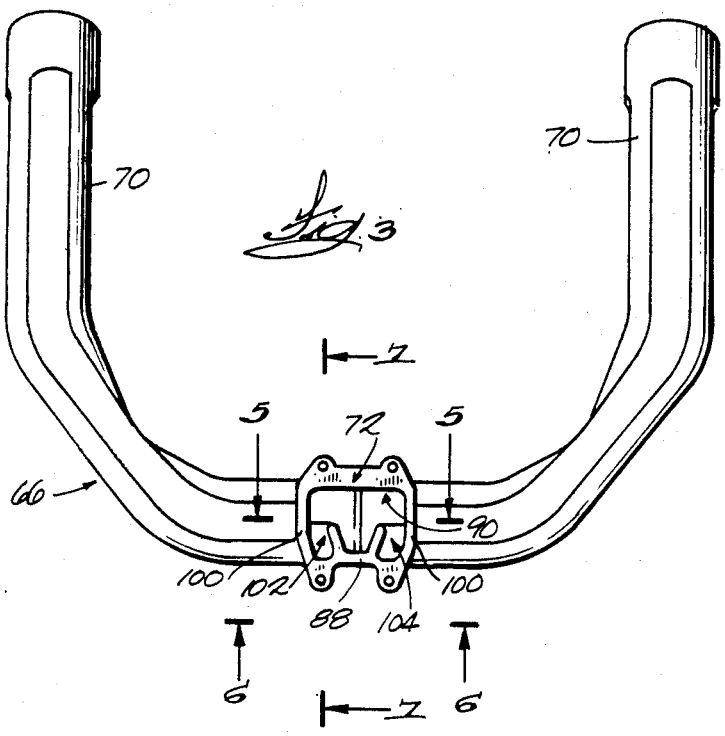
FIG. 3 is an elevational view of the rear end of the exhaust pipes and conduit section.
Figure 4:
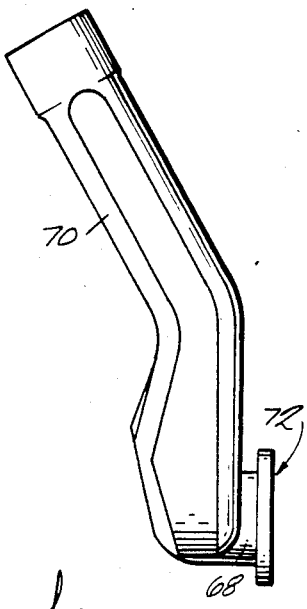
FIG. 4 is a side view of the exhaust pipes and conduit section shown in FIG. 3.
Figure 5:
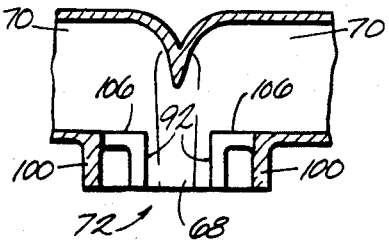
FIG. 5 is a partial cross sectional view taken along line 5—5 in FIG. 3.

Upstream of the point at which they converge, the exhaust pipes 70 are mirror images of each other. One pipe 70 communicates with one side of the engine 16, and the other pipe 70 communicates with the other side of the engine 16. As best shown in FIGS. 1, 3 and 4, the assembly of the two exhaust pipes 70 is generally U-shaped, with the upstream or upper ends of the pipes 70 communicating with the engine 16. The pipes 70 curve inwardly and somewhat rearwardly as they extend downwardly, and the pipes 70 turn so as to extend inwardly and generally horizontally just upstream of the point at which they converge. At the point at which the two pipes 70 converge, the forward walls (to the top in FIG. 5) of the two pipes 70 turn rearwardly and come to a point, as best shown in FIG. 5. The pipes 70 converge into the conduit section 68, and the curved forward walls of the exhaust pipes 70 cause the exhaust gases and coolant water in the exhaust pipes 70 to turn and flow into the conduit section 68. The conduit section 68 terminates in an end face 72 which abuts the front end of the gimbal housing 18 when the exhaust system is completely assembled.

Figure 2:
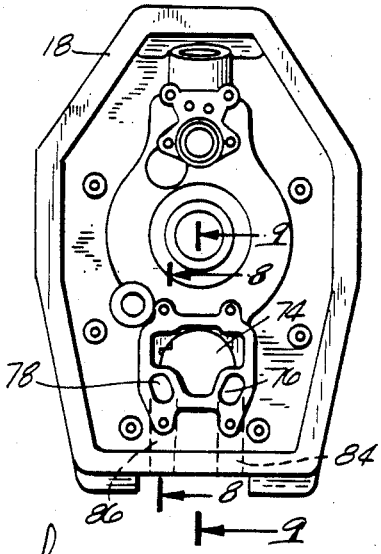
FIG. 2 is an elevational view of the front end of the gimbal housing.
Figure 9:
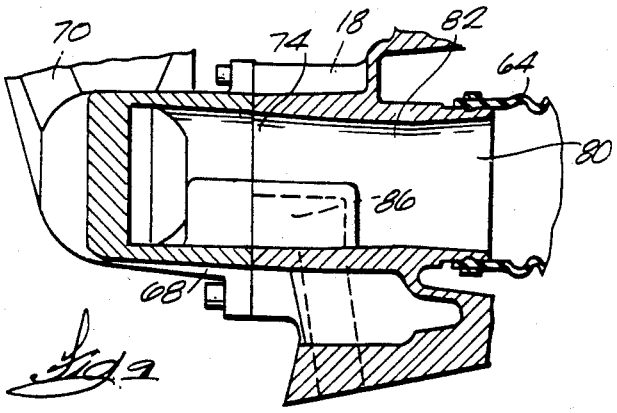
FIG. 9 is a cross sectional view taken along line 9—9 in FIG. 2, and further including the exhaust pipes and conduit section.

The gimbal housing 18 includes an exhaust opening 74 (see FIG. 2) in the front end thereof, a first exhaust relief opening 76 in the front end adjacent one side of the exhaust opening 74, a second exhaust relief opening 78 in the front end adjacent the other side of the exhaust opening 74, an exhaust outlet 80 (see FIG. 9), and an exhaust conduit 82 communicating between the exhaust opening 74 and the exhaust outlet 80. The exhaust conduit 82 is generally horizontal. The gimbal housing 18 also includes a first exhaust relief passage 84 having an upstream portion extending generally parallel to the exhaust conduit 82 and communicating with the first exhaust relief opening 76, and a downstream portion extending generally downwardly and communicating with the atmosphere, and a second exhaust relief passage 86 having an upstream portion extending generally parallel to the exhaust conduit 82 and communicating with the second exhaust relief opening 78, and a downstream portion extending generally downwardly and communicating with the atmosphere.

In the preferred embodiment, the exhaust opening 74 is generally T-shaped, and the exhaust conduit 82 is similarly T-shaped in cross section from the exhaust opening 74 to a point slightly rearward of the exhaust relief passages 84 and 86, at which point the exhaust conduit 82 becomes circular in cross section. The circular portion of the exhaust conduit 82 communicates with the exhaust outlet 80 which is also circular. The transition of the exhaust conduit 82 from T-shaped to circular in cross section can be seen in FIG. 2.

Figure 8:
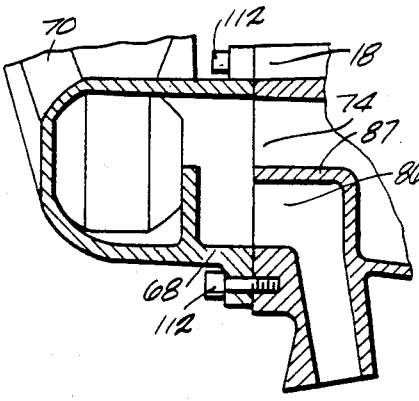
FIG. 8 is a cross sectional view taken along line 8—8 in FIG. 2, and further including the exhaust pipes and conduit section.

The upstream portions of the exhaust relief passages 84 and 86 are separated from the exhaust conduit 82 by upper walls 87 (see FIG. 8). In alternative embodiments of the invention, the upper walls 87 could be removed or could include ports therein communicating with the exhaust relief passages.

Figure 10:
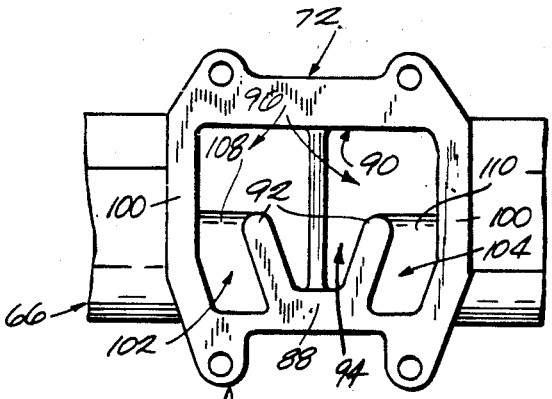
FIG. 10 is an enlarged view of the end face of the conduit section.

The conduit section 68 includes a generally horizontal bottom wall 88 (see FIG. 10) extending from the end face 72, a generally horizontal roof 90 spaced upwardly from the bottom wall 88 and extending from the end face 72, and a pair of sides 92 extending upwardly from the bottom wall 88 to define, in the end face 72, an exhaust discharge port 94, the sides 94 terminating in spaced relation to the roof 90 to define ports 96. The roof 90 includes, adjacent the end face 72, projecting portions extending laterally outwardly beyond the sides 92, and the conduit section 68 also includes outer side walls 100 extending downwardly from the roof 90 in spaced outer relation to the sides 92 and below the ports 96 to define, in the end face 72, first and second exhaust relief ports 102 and 104 respectively which are in communication with the ports 96.

Figure 7:
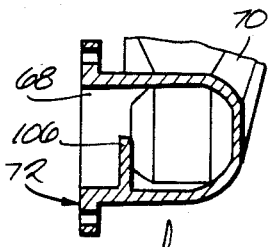
FIG. 7 is a partial cross sectional view of the exhaust pipes and conduit section taken along line 7—7 in FIG. 3.
Figure 6:
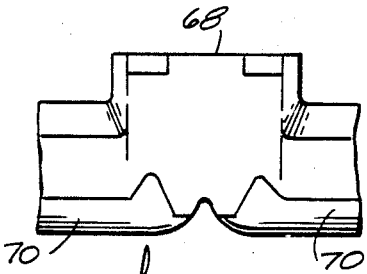
FIG. 6 is a partial bottom view of the exhaust Pipes and conduit section taken along line 6—6 in FIG. 3.

In the preferred embodiment, the sides 92 extend forwardly from the end face 72 of the conduit section 68 and are connected to end walls 106 (see FIG. 5) which extend laterally from the forward ends of the sides 92 and are connected to the outer side walls 100 of the conduit section 68. The end walls 106, like the sides 92, terminate in spaced relation to the roof 90 (see FIG. 7). The first or left side 92 and first or left end wall 106 (as viewed in FIG. 5) form a dam 108 (see FIG. 10) extending upwardly from the bottom 88 of the conduit section adjacent the left outer side wall 100. The second or right side 92 and second or right end wall 106 (as viewed in FIG. 5) form a second dam 110 extending upwardly from the bottom 88 of the conduit section 68 adjacent the right outer side wall 100. The bottom wall 88 and the first and second dams 108 and 110 or left and right sides 92 define a lower central portion of the conduit section 68.

The centrifugal forces resulting from the inward turn of the exhaust pipes 70 cause the water in the pipes 70 to flow along the bottoms or lower portions of the pipes 70. The force of gravity also causes the water to flow along the bottoms of the pipes 70. The centrifugal forces resulting from the rearward turn of the exhaust pipes 70 causes the water in the pipes 70, which is already flowing along the bottoms of the pipes 70, to flow to the central portion of the conduit section 68. Thus, the combined effect of the two turns in the exhaust pipes 70, an inward turn and a rearward turn, plus the force of gravity, is to cause the water from the exhaust pipes 70 to flow to the lower central portion of the conduit section 68.

The end face 72 of the conduit section 68 abuts the front end of the gimbal housing 18 such that the conduit section 68 communicates with the exhaust opening 74 and the first and second exhaust relief openings 76 and 78 in the front end of the gimbal housing 18. The conduit section 68 is removably secured to the gimbal housing 18 by bolts 112 (see FIG. 8). In particular, the exhaust discharge port 94 or the lower central portion and the upper portion of the conduit section 68 communicates with the exhaust opening 74 in the gimbal housing 18, and the first and second exhaust relief ports 102 and 104 respectively communicate with the first and second exhaust relief openings 76 and 78 in the gimbal housing 18. The first and second dams 108 and 110 are positioned upstream of the first and second exhaust relief openings 76 and 78, respectively, and they substantially prevent water from entering either of the exhaust relief openings 76 and 78.

As explained above, most of the water in the exhaust pipes 70 flows to the lower central portion of the conduit section 68 due to centrifugal forces and the force of gravity. Therefore, most of the water goes out of the conduit section 68 through the exhaust discharge port 94 and into the exhaust opening 74 and the exhaust conduit 82 in the gimbal housing 18, which lead to the exhaust outlet 60 in the propulsion unit 34. The flow out of the conduit section 68 through the exhaust relief ports 102 and 104 and into the exhaust relief openings 76 and 78 in the gimbal housing 18 is primarily exhaust gases. Therefore, exhaust gases are discharged into the atmosphere through the exhaust relief passages 84 and 86. This discharge of exhaust gases through the exhaust relief passages 84 and 86 relieves the backpressure on the engine 16.

Looking at the exhaust passageway formed by one of the exhaust pipes 70 and half of the conduit section 68, i.e., splitting FIG. 5 down the middle, the exhaust passageway includes a first portion (the central portion of the conduit section 68 or the outside of the turn) in which the water flows due to centrifugal forces, and a second portion (the portion adjacent the right side wall 100 of the conduit section 68 or the inside of the turn) in laterally adjacent spaced relation from the first portion. The marine propulsion device 10 then comprises means for relieving backpressure in the exhaust passageway by conducting exhaust gases away from the second portion (the inside of the turn) of the exhaust passageway. While various suitable means can be employed, in the preferred embodiment, this means includes the first exhaust relief passage 84 communicating between the second portion of the exhaust passageway and the atmosphere. Although the preferred embodiment includes two such exhaust passageways which are mirror images of each other and which converge into a single exhaust passage, it should be understood that the invention could also be embodied in an exhaust passageway comprising only a single exhaust pipe, including a first portion in which the water flows due to centrifugal forces, and a second portion spaced inwardly from the first portion.

As can be best understood by viewing FIG. 3, the exhaust passageway discussed above also includes an upper portion (the portion above the dam 108), and the first exhaust gas relief passage 84 communicates with the upper portion (the dam 108 prevents communication with the lower portion of the passageway) such that, due to the force of gravity and centrifugal forces, a substantial portion of the water does not enter the relief passage 84. As explained above, this is because the dam 108 or side 92 prevents a substantial portion of the water from entering the relief passage 84.

Various of the features and advantages of the invention are set forth in the following claims:

1. A marine propulsion device comprising a water cooled internal combustion engine adapted to be located forwardly of a boat transom, a tiltable and steerable propulsion unit adapted to be located aft of the boat transom and including an exhaust outlet normally located underwater, and an exhaust passageway communicating between said engine and said exhaust outlet for conducting exhaust gases and coolant water away from said engine for discharge through said exhaust outlet, said exhaust passageway including structure adapted to be fixed relative to the boat transom and faciliting passage of exhaust gases and coolant water from forwardly of to aft of the transom, a first arcuately extending passageway portion extending forwardly from said structure and in which water flows due to centrifugal force, a second arcuately extending passageway portion which extends forwardly from said structure in laterally adjacent spaced relation to said first portion and which is substantially free of water, and means extending in said structure and communicating with said second portion and with the atmosphere independently of said exhaust outlet for discharging exhaust gases to the atmosphere and so as thereby to relieve back pressure in said exhaust passageway by conducting exhaust gases away from said second portion of said exhaust passageway and thereby to reduce exhaust gas flow through said exhaust outlet.

2. A marine propulsion device as set forth in claim 1 wherein said means in said structure includes an exhaust gas relief passage communicating between said second portion of said exhaust passageway and the atmosphere.

3. A marine propulsion device as set forth in claim 2 wherein said exhaust passageway also has an upper portion, and wherein said exhaust gas relief passage communicates with said upper portion such that, due to the force of gravity and centrifugal force, a substantial portion of the water does not enter said relief passage.

4. A marine propulsion device comprising a water cooled internal combustion engine adapted to be located inside of and substantially stationarily relative to a boat hull, a tiltable and steerable propulsion unit adapted to be located exteriorly of the boat hull and including an exhaust outlet normally located underwater, and an exhaust passageway communicating between said engine and said exhaust outlet for conducting exhaust gases and coolant water away from said engine for discharge through said exhaust outlet, said exhaust passageway including structure adapted to be fixed relative to the boat transom and faciliting passage of exhaust gases and coolant water from forwardly of to aft of the transom, an upper portion adapted to be located inside the boat hull and extending forwardly from said structure, and a downwardly extending exhaust gas relief passage located in said structure and exteriorly of the boat hull and communicating between said upper portion of said exhaust passageway and the atmosphere above the water for conducting exhaust gases away from said exhaust passageway so as to reduce exhaust gas discharge through said exhaust outlet.

5. A marine propulsion device comprising a water cooled internal combustion engine, a gimbal housing adapted to be mounted on a boat transom and including a front end, an exhaust opening in said front end, a first exhaust relief opening in said front end adjacent one side of said exhaust opening, a second relief opening in said front end adjacent the other side of said exhaust opening, an exhaust outlet, an exhaust conduit communicating between said exhaust opening and said exhaust outlet, a first exhaust relief passage communicating between said first exhaust relief opening and the atmosphere, and a second exhaust relief passage communicating between said second exhaust relief opening and the atmosphere, and an exhaust system communicating between said engine and said exhaust opening for conducting exhaust gases and coolant water away from said engine, and communicating between said engine and said first and second exhaust relief openings for conducting exhaust gases away from said engine.

6. A marine propulsion device as set forth in claim 5 wherein said exhaust system includes a conduit section communicating with said exhaust opening and said first and second exhaust relief openings, said conduit section having opposite first and second sides, a bottom, a first dam extending upwardly from said bottom adjacent said first side and being positioned upstream of said first exhaust relief opening, and a second dam extending upwardly from said bottom adjacent said second side and being positioned upstream of said second exhaust relief opening, said bottom and said first and second dams defining a lower central portion of said conduit section, and said first and second dams substantially preventing water from entering said first and second exhaust relief openings, and a pair of exhaust pipes communicating between said engine and said conduit section, said exhaust pipes converging into said conduit section and having arcuate sections immediately upstream of said conduit section such that the water flows to said lower central portion of said conduit section due to centrifugal forces and the force of gravity.

7. A marine propulsion device as set forth in claim 5 wherein said exhaust conduit is generally horizontal and has an upstream end communicating with said exhaust opening, and a downstream end communicating with said exhaust outlet, wherein said first exhaust relief passage has an upstream portion extending generally parallel to said exhaust conduit and communicating with said first exhaust relief opening, and a downstream portion extending generally downwardly and communicating with the atmosphere, and wherein said second exhaust relief passage has an upstream portion extending generally parallel to said exhaust conduit and communicating with said second exhaust relief opening, and a downstream portion extending generally downwardly and communicating with the atmosphere.

8. A marine propulsion device as set forth in claim 5 wherein said exhaust system includes a conduit section including an end face abutting said front end of said gimbal housing, a bottom wall extending from said end face, a roof extending from said end face, a pair of sides extending upwardly from said bottom wall to define, in said end face, an exhaust discharge port communicating with said exhaust opening in said gimbal housing, said sides terminating in spaced relation to said roof to define ports, said roof including, adjacent said end face, projecting portions extending laterally outwardly beyond said sides, and said conduit section also including outer side walls extending downwardly from said roof in spaced outer relation to said sides and below said ports to define, in said end face, first and second exhaust relief ports respectively communicating with said first and second exhaust relief openings in said gimbal housing.

9. A marine propulsion device comprising a water cooled internal combustion engine, a gimbal housing adapted to be mounted on a boat transom and including a front end, an exhaust opening in said front end, a first exhaust relief opening in said front end adjacent one side of said exhaust opening, a second exhaust relief opening in said front end adjacent the other side of said exhaust opening, an exhaust outlet, a generally horizontal exhaust conduit having an upstream end communicating with said exhaust opening, and a downstream end communicating with said exhaust outlet, a first exhaust relief passage adjacent one side of said exhaust conduit and having an upstream portion extending generally parallel to said exhaust conduit and communicating with said first exhaust relief opening, and a downstream portion extending generally downwardly and communicating with the atmosphere, and a second exhaust relief passage adjacent the other side of said exhaust conduit and having an upstream portion extending generally parallel to said exhaust conduit and communicating with said second exhaust relief opening, and a downstream portion extending generally downwardly and communicating with the atmosphere, and an exhaust system communicating between said engine and said gimbal housing and conducting exhaust gases and coolant water away from said engine, said exhaust system including a conduit section communicating with said exhaust opening and said first and second exhaust relief openings, said conduit section having opposite first and second sides, a bottom, a first dam extending upwardly from said bottom adjacent said first side and being positioned upstream of said first exhaust relief opening, and a second dam extending upwardly from said bottom adjacent said second side and being positioned upstream of said second exhaust relief opening, said bottom and said first and second dams defining a lower central portion of said conduit section, and said first and second dams substantially preventing water from entering said first and second exhaust relief openings, and a pair of exhaust pipes communicating between said engine and said conduit section, said exhaust pipes converging into said conduit section and having arcuate sections immediately upstream of said conduit section such that the water flows to said lower central portion of said conduit section due to centrifugal forces and the force of gravity.

10. An exhaust conduit for conducting exhaust gases and cooling water from a pair of laterally spaced portions of an internal combustion engine to a gimbal housing adapted to be secured to the transom of a boat, said conduit being generally U-shaped and including two upwardly extending legs including interior ducts, and a connection portion joining said legs and including an interior duct portion communicating with said interior ducts, said connecting portion also including a flat mounting face adapted for mounting to the gimbal housing, said flat face including therein a central opening for conveying cooling water to the gimbal housing, said flat face also including a pair of spaced ports respectively located in spaced relation to, and on opposite sides of, said central opening for conveying exhaust gases to the gimbal housing.

11. An exhaust conduit in accordance with claim 10 and further including means connecting said central opening with said duct portion for conveying water from said duct portion to said central opening.

12. An exhaust conduit in accordance with claim 10 and further including means connecting said laterally spaced ports with said duct portion for conveying exhaust gases from said duct portion to said laterally spaced ports.

* * * * *